US006335673B1

(12) United States Patent
Houbre et al.

(10) Patent No.: US 6,335,673 B1
(45) **Date of Patent: *Jan. 1, 2002**

(54) CURRENT TRANSFORMER AND ITS MANUFACTURING PROCESS

(75) Inventors: Pascal Houbre, St. Martin D'Heres; Claude Rubbo, Grenoble, both of (FR)

(73) Assignee: Schneider Electric SA (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,116

(22) Filed: Nov. 21, 1997

Related U.S. Application Data

(63) Continuation-in-part of application No. 08/754,064, filed on Nov. 20, 1996, now abandoned.

(30) Foreign Application Priority Data

Dec. 14, 1995 (FR) ..... 9515201

(51) Int. Cl.[7] ..... H01F 27/24

(52) U.S. Cl. ..... 336/234; 336/210; 336/216; 29/606

(58) Field of Search ..... 336/233, 234, 336/216, 210; 29/606, 609

(56) References Cited

U.S. PATENT DOCUMENTS

| | | | | | |
|---|---|---|---|---|---|
| 1,401,493 | A | | 12/1921 | Replogle | |
| 1,720,100 | A | * | 8/1929 | Da Costa | 336/210 |
| 3,034,203 | A | * | 5/1962 | Vienneau et al. | 29/155.57 |
| 3,201,731 | A | * | 8/1965 | Baenziger et al. | 336/216 |
| 4,158,186 | A | * | 6/1979 | Philbert et al. | 29/606 |
| 5,457,873 | A | * | 10/1995 | Cattaneo | 336/184 |

FOREIGN PATENT DOCUMENTS

| | | | | |
|---|---|---|---|---|
| DE | 488284 | | 1/1930 | |
| EP | 0439410 | | 7/1991 | |
| FR | 549682 | | 2/1923 | |
| GB | 686873 | * | 2/1952 | 336/216 |
| WO | 93/14509 | | 7/1993 | |

* cited by examiner

*Primary Examiner*—Anh Mai
(74) *Attorney, Agent, or Firm*—Parkhurst & Wendel, L.L.P.

(57) ABSTRACT

The current transformer comprises a magnetic circuit and a secondary winding. The magnetic circuit is formed by stacked metal plates. Each plate comprises a cut-out without an air-gap. The magnetic circuit comprises a fixed first part enabling the secondary winding to be received and a flexible second part able to be momentarily deformed. The current transformer is advantageously used in protection relays and electronic trip devices of circuit breakers.

9 Claims, 5 Drawing Sheets

CURRENT TRANSFORMER AND ITS MANUFACTURING PROCESS

This is a Continuation-In-Part of application Ser. No. 08/754,064 filed Nov. 20, 1996, now abandoned.

BACKGROUND OF THE INVENTION

The invention relates to a current transformer comprising a closed magnetic circuit made up of stacked metal plates surrounding a primary conductor, and a secondary winding whose core is a part of the magnetic circuit.

Known current transformers, used notably in trip relays or circuit breakers, supply electrical power and current measuring signals to processing units. In state-of-the-art manner, the transformers comprise a primary winding formed by a power conductor through which a strong current flows, a magnetic circuit surrounding the power conductor and a secondary winding formed by one or two coils situated on the magnetic circuit.

The magnetic circuit of the transformers is constituted by stacked metal plates. To enable the coils of the secondary winding to be fitted, the plates preferably have open shapes. The plates are inserted inside the coils then fixed to one another so as to close the magnetic circuit.

Fixing of the stacked plates is performed by weldings which secure the stacks of plates end to end. With this fixing mode the magnetic circuit is liable to present large air-gaps due to the irregularities of the cut-outs of the plates and of the stacking. These air-gaps reduce the performances of the transformer at low current.

Current transformers exist comprising a magnetic circuit formed by closed and stacked plates not presenting any air-gap. In these transformers, the secondary winding has to be coiled directly onto the magnetic circuit. This manufacturing mode eliminates the risks of presence of air-gaps but considerably increases the complexity, manufacturing time and cost of the transformers.

SUMMARY OF THE INVENTION

The object of the invention is to achieve a current transformer having a high response at low current and which is simple and quick to manufacture.

This object is achieved by the fact that each plate of the magnetic circuit is formed by a single part surrounding the primary conductor and being severed to define a gap or cut-out at a single location, the plates being stacked in the same position, the cut-out of each plate coinciding with the cut-outs of the other plates.

In a preferred embodiment, the magnetic circuit comprises a fixed first part designed to receive the secondary winding and a flexible second part able to be momentarily deformed.

The transformer may comprise securing means to hold the plates in the plane of their cutting.

The plate cut-outs are preferably located in a part of the magnetic circuit prolonging the core of the secondary winding, the plates being, for example, cut perpendicularly to the axis of the secondary winding or parallel to the axis of the secondary winding.

According to a particular embodiment the magnetic circuit is rectangular in shape and comprises a first large side receiving the secondary winding, a second large side opposite the first large side, and two small sides, the cut-outs of the magnetic circuit being situated between the first large side and an adjacent small side. The fixed first part of the magnetic circuit comprises the first large side and the flexible second part comprises at least the opposite large side or the adjacent small side. In this embodiment, the cut-outs are preferably made according to a line bisecting a right angle formed by the first large side and an adjacent small side.

In a manufacturing process of a transformer according to the invention, the metal plates are cut at a single place and stacked making the cut-outs of each plate correspond, then, in a first stage a flexible part of the plates of the magnetic circuit is deformed, in a second stage a secondary winding coil is arranged on a fixed part of the magnetic circuit, and in a third stage the flexible part of the plates of the magnetic circuit is put back in the normal position, the fixed and flexible parts of each plate being aligned according to their cutting plane.

BRIEF DESCRIPTION OF THE DRAWINGS

Other advantages and features will become more clearly apparent from the following description of embodiments of the invention, given as non-restrictive examples only, and represented in the accompanying drawings in which.

DETAILED DESCRIPTION OF THE PREFERRED EMBODIMENT

Figure 1:
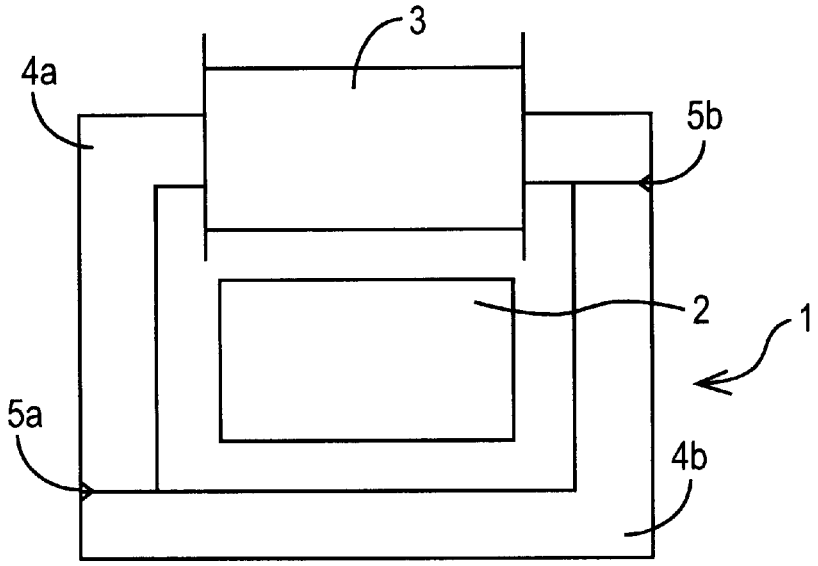
FIG. 1 PRIOR ART
FIG. 1 represents a known current transformer with stacked plates.

The known transformer of FIG. 1 comprises a magnetic circuit 1 surrounding a primary conductor 2 of high intensity and a coil 3 forming a secondary winding. The magnetic circuit is formed by two independent stacks of metal plates 4*a* and 4*b*.

When the transformer is manufactured, the stack of metal plates 4*a* is placed inside the coil, in such a way as to form a magnetic core.

The plates of FIG. 1 are L-shaped. The two stacks 4*a* and 4*b* are securedly affixed in the head-to-tail position, after having been fitted in the coils, by two welding seams 5*a* and 5*b*.

Figure 2:
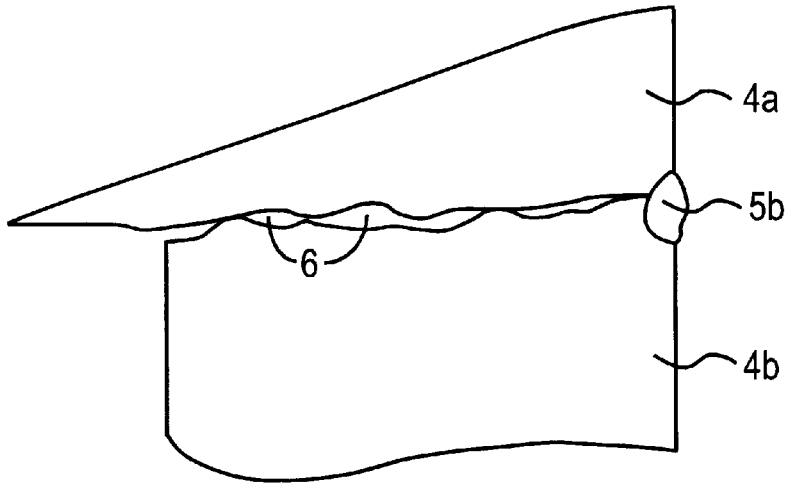
FIG. 2 PRIOR ART
FIG. 2 represents, in an enlarged scale view, the juxtaposition of the stacked plates of the transformer of FIG. 1.

At the junctions of the stacks of metal plates, irregularities due to the cutting tools decrease the performances of the transformer. FIG. 2 shows an example of irregularities 6 at the junction of the metal plates. These cutting irregularities 6 introduce small local air-gaps which have a negative effect on the response of the transformer at low current level.

In a transformer according to the invention, the response for low current values is improved.

Figure 3:
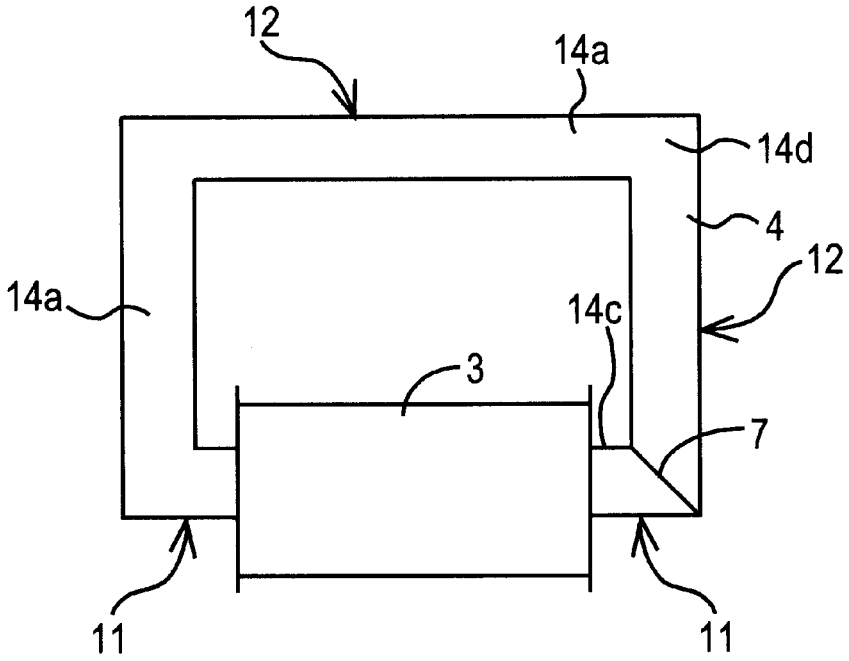
FIG. 3 represents an embodiment of a current transformer according to the invention.

FIG. 3 shows a transformer according to a first embodiment of the invention. A magnetic circuit 4 comprises a single stack of metal plates only. Each plate is severed to define a gap or cut-out 7 allowing a momentary deformation of the magnetic circuit. The plates of the magnetic circuit are stacked in such a way that the cut-outs coincide along the same perpendicular plane with the surface of said plates.

The magnetic circuit 4 of FIG. 3 is of rectangular shape comprising two large sides 14*a* and 14*c* and two small sides 14*b* and 14*d*. The side 14*c* of the magnetic circuit receives a secondary winding coil 3. The cut-out is performed according to a bisecting line of the right angle formed by the large side 14*c* and the small side 14*d*.

The irregularities present on each side of the cut-outs are complementary. This complementary nature compensates for the effects of the irregularities and no longer disturbs the flow of the magnetic flux. Thus, said cut-outs avoid small local air-gaps.

Figure 4:
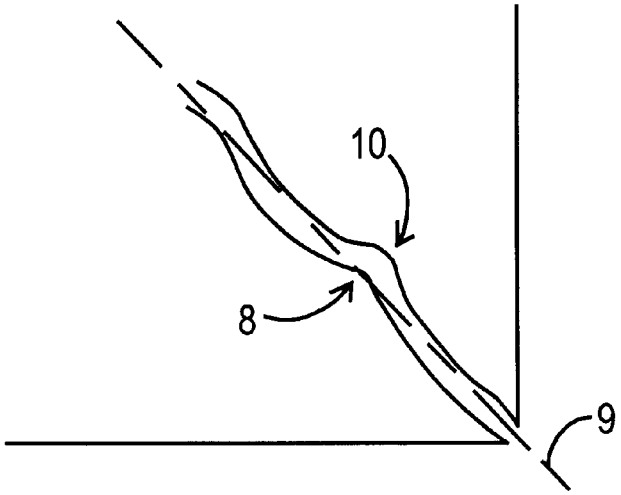
FIG. 4 shows, in an enlarged scale view, a cut-out of a plate of the transformer of FIG. 3.
Figure 10:
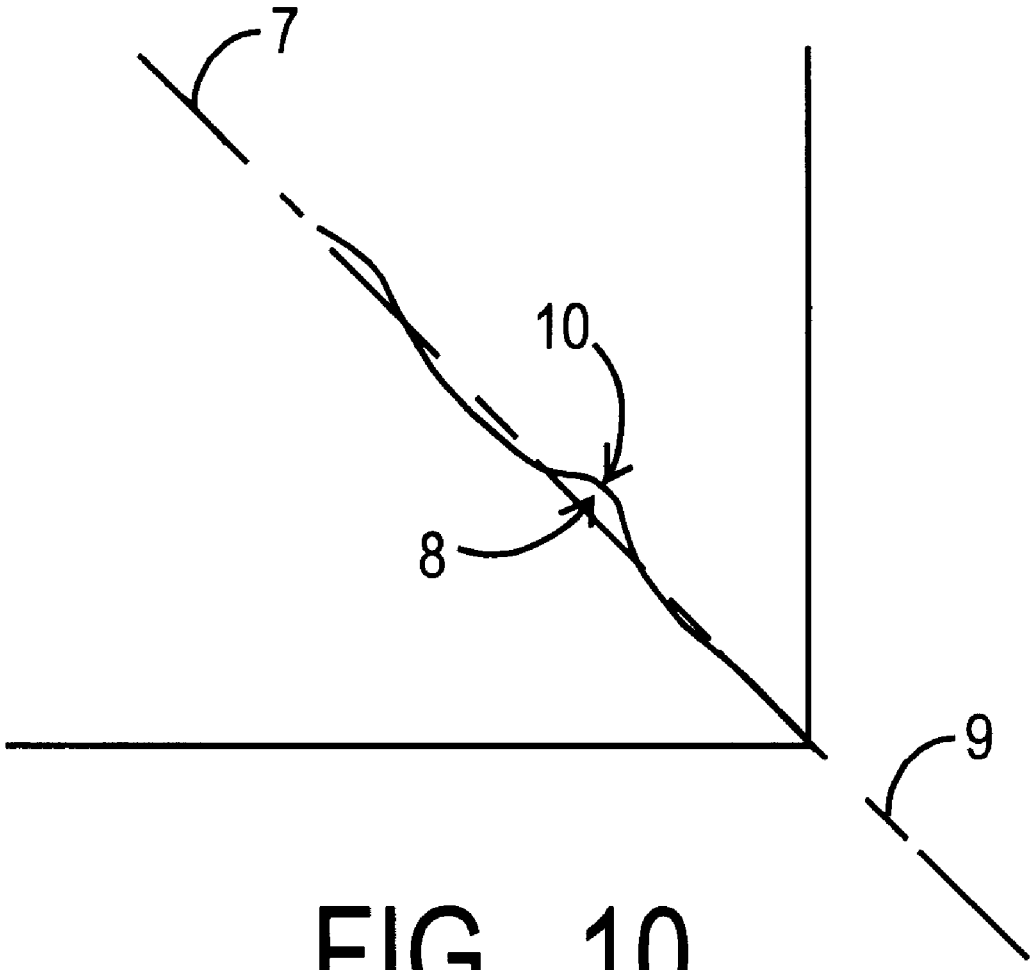
FIG. 10 shows, in an enlarged view, a closely mated cut-out of the transformer of FIG. 3.

A partial view of a cut-out in the separated position is represented in FIG. 4. In this view, a first irregularity 8 of the cut-out protruding beyond a middle cut-out line 9 is compensated by a second irregularity 10, complementary to the first one and situated on the other side of the cut-out withdrawn from this same middle line. Accordingly, as shown in FIGS. 4 and 10, since substantially all irregularities on each side of the cut-out are complementary, small local air-gaps are avoided. FIGS. 4 and 10 show that all of the irregularities are complementary.

The complementary contour of the sides of the cut-out depends on the shape of the tool used to form the cut-out. This tool, however, should preferably not remove metal material from the metal plates. Shears or a cutting knife are examples of tools that may be used to obtain the desired complementary cut-out.

In the embodiment of FIG. 3, the magnetic circuit 4 of the current transformer comprises a first part 11 forming the core of the secondary coil 3 and a second part 12 able to be momentarily deformed.

The first part 11 comprises at least the side 14*c* receiving the coil. The second part 12 comprises at least the side 14*d* adjacent to the side 14*c* and separated by the cut-out, or the large side 14*a* opposite the large side 14*c*.

Fitting of the secondary winding coil 3 onto the magnetic circuit is performed in three stages. A first stage consists in holding the first part 11 of the magnetic circuit and deforming the second part 12 momentarily. Then (second stage), while the second part is kept deformed, the first part is inserted inside the coil so as to constitute the magnetic core. Finally, in a third stage, the second part 12 is repositioned in its normal position.

Figure 5:
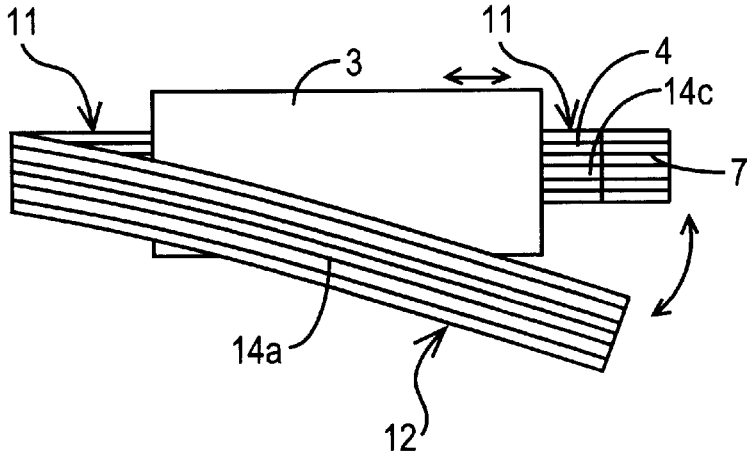
FIG. 5 shows a momentary deformation of the magnetic circuit of the transformer according to FIG. 3.

FIG. 5 shows a current transformer at the moment when the plates of the part 12 of the magnetic circuit are deformed to enable the coil 3 to be fitted onto the part 11. In this figure only the large side 14*a* of the part 12, opposite the large side 14*c* of the fixed part, is deformed.

Figure 6:
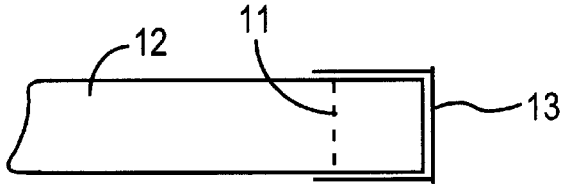
FIGS. 6 and 7 show two views of a securing device of the stacked plates for a transformer according to FIG. 3.
Figure 7:
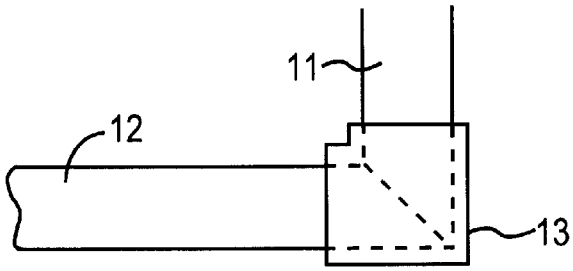

In FIGS. 6 and 7 the fixed and flexible parts respectively 11 and 12 of the magnetic circuit are held by a securing device 13. The device 13 holds the plates tightly pressed against one another and aligned on both sides of the cut-out so as to prevent risks of air-gaps.

In other embodiments the securing device can be integrated in an apparatus receiving the current transformer, for example a circuit breaker.

FIGS. 3 to 7 show magnetic circuits having metal plates cut out according to the bisecting line of a right angle between two adjacent sides of a rectangular magnetic circuit. But it is possible to cut out the plates at other locations, for example perpendicularly to sides of the magnetic circuit.

Figure 8:
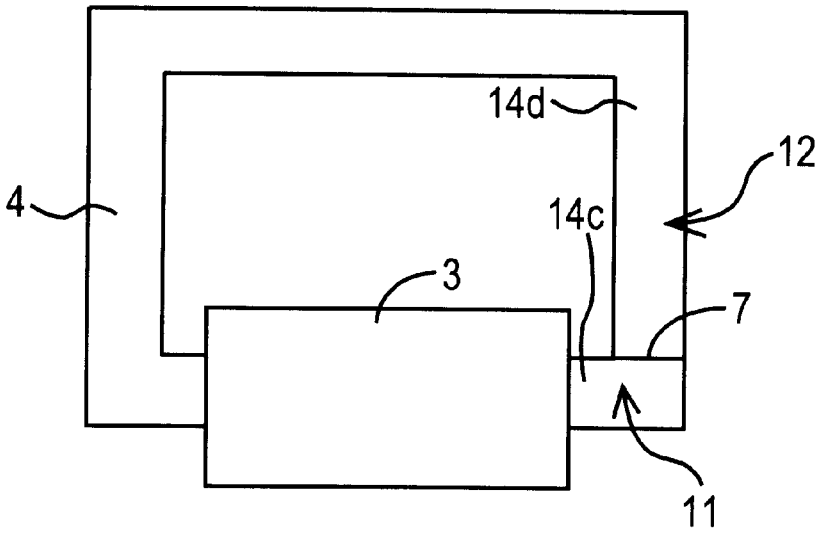
FIGS. 8 and 9 show two other embodiments of transformers according to the invention.
Figure 9:
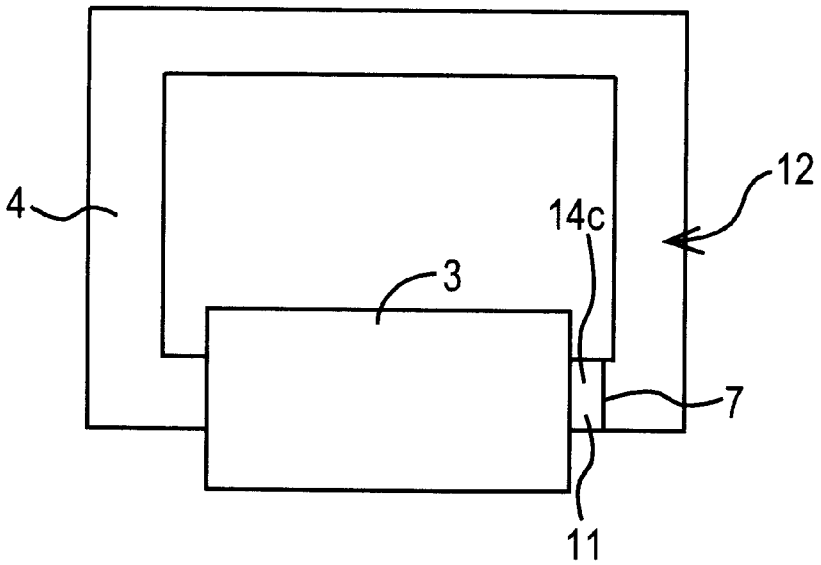

FIGS. 8 and 9 show other possible examples of cut-outs 7. The cut-out of FIG. 8 is situated on the prolongation of the large side 14*c* of the fixed part receiving the coil 3, perpendicularly to the small side 14*d* adjacent to the large side 14*c*, whereas the cut-out of FIG. 9 is on the large side 14*c* of the magnetic circuit, perpendicularly to the axis of the coil 3.

The transformers described above comprise a single coil 3, but it is possible, in other embodiments of the invention, to arrange several secondary winding coils on the part of the magnetic circuit constituting the core.

In the examples given above, the magnetic circuits are rectangular, but it is possible to use magnetic circuits of different shape, notably of square shape.

The secondary winding coil is preferably situated in the longest part of the magnetic circuit, but it could just as well be located on a small side of a rectangular magnetic circuit.

What is claimed is:

1. A current transformer having a closed magnetic circuit, comprising:

a plurality of stacked planar metal plates defining the closed magnetic circuit, each plate containing an opening in a center portion thereof for surrounding a primary conductor, each one of the plurality of metal plates being unitary and severed at a single location without removing any material therefrom to define complementary irregularities on each side of the severed area, the metal plates being stacked in the same position with respect to each other such that the severed area of each plate is aligned with the severed area of each of the other plates to enable a portion of said stack of plates to be deflected from the normal position, said complementary irregularities being brought together when said plates are in the normal position to avoid air gaps in the severed areas and to improve transformer response for low current; and a secondary winding having a core that is a part of the magnetic circuit.

2. The current transformer according to claim 1, wherein the magnetic circuit comprises a fixed first part designed to receive the secondary winding and a flexible second part able to be momentarily deformed.

3. The current transformer according to claim 2, further comprising securing means to hold the plates against one another and aligned in the severed area to eliminate air gaps.

4. The current transformer according to claim 1, wherein the magnetic circuit is rectangular in shape and comprises a first large side receiving the secondary winding, a second large side opposite the first large side, and two small sides, the severed area of each plate of the magnetic circuit being situated between the first large side and an adjacent small side.

5. The current transformer according to claim 4, wherein the fixed first part of the magnetic circuit comprises the first large side and the flexible second part comprises at least one of the opposite large side and the adjacent small side.

6. The current transformer according to claim 4, wherein the severed area of each plate of the magnetic circuit is made according to a line bisecting a right angle formed by the first large side and an adjacent small side.

7. The current transformer according to claim 1, wherein the severed area of each plate is located in a part of the magnetic circuit prolonging the core of the secondary winding, the plates being severed perpendicularly to the axis of the secondary winding.

8. The current transformer according to claim 1, wherein the severed area of each plate is located in a part of the magnetic circuit prolonging the core of the secondary winding, the plates being severed parallel to the axis of the secondary winding.

9. The current transformer according to claim 1, wherein the severed area of each plate is located in a part of the magnetic circuit prolonging the core of the secondary winding.

* * * * *